US009615637B1

(12) United States Patent
Tung

(10) Patent No.: US 9,615,637 B1
(45) Date of Patent: Apr. 11, 2017

(54) UMBRELLA WITH ORIENTATION ADJUSTABLE CANOPY IN A TILT POSITION

(71) Applicant: Benson Tung, Kaohsiung (TW)

(72) Inventor: Benson Tung, Kaohsiung (TW)

( * ) Notice: Subject to any disclaimer, the term of this patent is extended or adjusted under 35 U.S.C. 154(b) by 0 days.

(21) Appl. No.: 15/156,499

(22) Filed: May 17, 2016

(51) Int. Cl.
*A45B 17/00* (2006.01)
*A45B 25/14* (2006.01)

(52) U.S. Cl.
CPC ..... *A45B 17/00* (2013.01); *A45B 2017/005* (2013.01); *A45B 2025/146* (2013.01)

(58) Field of Classification Search
CPC ..... A45B 17/00; A45B 2017/005; A45B 2025/146
See application file for complete search history.

(56) References Cited

U.S. PATENT DOCUMENTS

| | | | | |
|---|---|---|---|---|
| 3,311,119 | A | 3/1967 | Pearlstine | 135/20.3 |
| 3,926,202 | A | 12/1975 | Uthemann et al. | 135/20.3 |
| 4,878,509 | A | 11/1989 | Tung | 135/20 |
| 6,575,182 | B2 | 6/2003 | Tung | 135/20.1 |
| 6,575,183 | B2 | 6/2003 | Tung | 135/20.3 |
| 7,412,985 | B2 * | 8/2008 | Ma | A45B 17/00 135/20.1 |
| 7,438,077 | B1 | 10/2008 | Wilson | 135/20.3 |
| 7,958,901 | B2 | 6/2011 | Lai | 35/20.3 |
| 8,291,923 | B2 | 10/2012 | Young et al. | 135/20.1 |
| 8,402,981 | B2 * | 3/2013 | Liu | A45B 17/00 135/15.1 |
| 8,522,804 | B1 | 9/2013 | Tung | 135/20.1 |
| 8,534,304 | B1 | 9/2013 | Tung | 135/20.1 |
| 8,763,620 | B1 | 7/2014 | Tung | 135/20.1 |
| 8,899,250 | B1 | 12/2014 | Tung | 135/20.1 |
| 9,380,844 | B1 * | 7/2016 | Luo | A45B 25/08 |
| 2011/0005558 | A1 | 1/2011 | Lai | 135/20.1 |
| 2015/0059815 | A1 * | 3/2015 | Xiong | A45B 17/00 135/20.1 |

* cited by examiner

*Primary Examiner* — David R Dunn
*Assistant Examiner* — Danielle Jackson
(74) *Attorney, Agent, or Firm* — Alan D. Kamrath; Kamrath IP Lawfirm, P.A.

(57) ABSTRACT

An umbrella includes a fixing tube and a coupling member mounted on an end of the fixing tube. A positioning ring is mounted around and not rotatable relative to the coupling member. A rotational sleeve is rotatably mounted to the coupling member and is spaced from the positioning ring. A driving jacket is mounted around the connecting ring and the positioning ring. The driving jacket is fixed to the positioning ring and is movable between an engagement position in which the positioning ring engages with the connecting ring and a disengagement position in which the positioning ring disengages from the connecting ring. The rotational sleeve is rotatable relative to the coupling member when the driving jacket is in the disengagement position, permitting a change in an orientation of a tilted canopy of the umbrella to face the sun for obtaining a better shielding effect.

7 Claims, 12 Drawing Sheets

UMBRELLA WITH ORIENTATION ADJUSTABLE CANOPY IN A TILT POSITION

BACKGROUND OF THE INVENTION

The present invention relates to an umbrella and, more particularly, to an umbrella with a canopy adjustable in orientation when the canopy is in a tilt position.

A large-size outdoor umbrella generally includes a rib hub to which a plurality of ribs is mounted for supporting a canopy. The umbrella further includes a plurality of stretchers and a runner slideably mounted around a shaft of the umbrella. An end of each stretcher is pivotably connected to the runner. The other end of each stretcher is pivotably connected to one of the ribs. When the runner moves towards the rib hub along the longitudinal direction of the shaft, the stretchers push the ribs away from the shaft to open the canopy for shielding sunlight or rainwaters.

Since the position of the sun changes as time passes, the shadow below the umbrella also changes. In a solution to change the position of the canopy, the canopy can manually be tilted and then pivoted to respond to variation in the sun's position, thereby facing the sun to obtain the best shielding effect.

In an approach to permit pivotal movement of the canopy in the tilted position, the umbrella includes a member movable along an inner thread in a threaded component. However, the threaded component with the inner thread cannot easily be assembled with other components. In an approach to solve this disadvantage, the threaded component is separated into two halves each having a shorter inner thread section, and the shorter inner thread sections are connected when the two halves of the threaded component are assembled. However, pivoting the tilted canopy imparts a considerable force to the threaded component, which causes a potential risk of forming a gap between the two halves of the threaded component and, hence, a gap between the shorter inner thread sections, resulting in non-smooth pivotal operation of the canopy and difficulties in pivoting the canopy to the desired angular position for shielding the sun.

Thus, a need exists for a novel umbrella that mitigates and/or obviates the above disadvantages.

BRIEF SUMMARY OF THE INVENTION

The present invention solves this need and other problems in the field of easy operation in adjusting the orientation of a tilted canopy of an umbrella by providing an umbrella including a fixing tube including first and second ends spaced from each other along a longitudinal axis. A coupling member includes a coupling portion and a guiding portion extending along the longitudinal axis and having an upper end. An axle extends from the upper end of the guiding portion and extends along the longitudinal axis. The coupling portion of the coupling member is fixed to the first end of the fixing tube. A positioning ring is mounted around the coupling member. The positioning ring includes an upper end having a fixing toothed portion. The positioning ring is mounted to and not rotatable relative to the guiding portion of the coupling member. A spring is mounted around the guiding portion of the coupling member. The spring biases the positioning ring towards the axle. A rotational sleeve is rotatably mounted to the axle of the coupling member.

The umbrella further includes a connecting ring fixed to an outer periphery of the rotational sleeve. The connecting ring includes a lower end having a connecting toothed portion. The connecting ring and the rotational sleeve are jointly rotatable about the longitudinal axis. A driving jacket includes a chamber in which the connecting ring is received. The positioning ring is received in the chamber and is rotatable relative to driving jacket. The driving jacket is movable along the longitudinal axis between an engagement position in which the positioning ring engages with the connecting ring and a disengagement position in which the positioning ring disengages from the connecting ring. The driving jacket, the connecting ring, and the rotational sleeve are jointly rotatable about the longitudinal axis. A movable tube includes a lower end located around the rotational sleeve and an upper end located around the driving jacket and spaced from the lower end along the longitudinal axis. The movable tube and the rotational sleeve are jointly rotatable about the longitudinal axis.

The umbrella further includes a canopy operating device including a rotational member fixed to the upper end of the movable tube and a tilt member pivotably connected to the rotational member. The canopy operating device further includes an extension rod having a lower end fixed to the tilt member and an upper end. The tilt member and the extension rod are pivotable relative to the rotational member between an upright position and a tilt position. A rib hub is fixed to the upper end of the extension rod. Each of a plurality of ribs has an end pivotably connected to the rib hub. A runner is slideably mounted around the canopy operating device and is moveable along the canopy operating device between an upper position and a lower position. Each of a plurality of stretchers includes a first end pivotably connected to the runner and a second end pivotably connected to one of the plurality of ribs.

When the tilt member is in the upright position, the extension rod, the fixing tube, and the movable tube are located on a same straight line, permitting the runner to move between the upper position and the lower position. When the tilt member is in the tilt position, the extension rod is tilted relative to the fixing tube and the movable tube. When the runner is in the lower position, the tilt member is not permitted to pivot from the upright position to the tilt position, and each of the plurality of stretchers is located adjacent to the extension rod to collapse the plurality of ribs. When the runner is in the upper position, the tilt member is permitted to pivot from the upright position to the tilt position, and each of the plurality of stretchers is spaced from the extension rod to stretch open the plurality of ribs. When the driving jacket is in the engagement state, the fixing toothed portion of the positioning ring engages with the connecting toothed portion of the connecting ring, avoiding the connecting ring, the rotational sleeve, the driving jacket, and the canopy operating device from pivoting about the longitudinal axis. When the driving jacket is in the disengagement state, the fixing toothed portion of the positioning ring disengages from the connecting toothed portion of the connecting ring, permitting the connecting ring, the rotational sleeve, the driving jacket, and the canopy operating device from pivoting about the longitudinal axis. When the runner is in the upper position and the tilt member is in the tilt position, the driving jacket is operable to change an orientation of the rib hub.

The connecting ring can further include an actuating block formed on an outer periphery and an engagement groove in an inner periphery thereof. The driving jacket can further include an actuating groove in an inner periphery of the chamber. The rotational sleeve can include an engagement block on an outer periphery thereof. The actuating block of the connecting ring is slideably received in the actuating groove of the driving jacket, permitting joint rotation of the driving jacket and the actuating block about the longitudinal axis and permitting the driving jacket to slide relative to the connecting ring along the longitudinal axis. The engagement block of the rotational sleeve is securely engaged in the engagement groove of the connecting ring, permitting joint rotational movement of the rotational sleeve and the connecting ring about the longitudinal axis.

In an example, the chamber of the driving jacket includes a first section extending from a bottom thereof and a second section extending from a top end thereof to the first section and having a diameter smaller than a diameter of the first section. A pressing face is formed at an intersection between the first and second sections. The driving jacket further includes an actuating groove in an inner periphery thereof. The positioning ring further includes a protrusion on an outer periphery thereof. The protrusion presses against the pressing face of the driving jacket to move the driving jacket and the positioning ring between the engagement position and the disengagement position.

The coupling member can further include a guiding groove in an outer periphery of the guiding portion. The umbrella can further include a guiding pin mounted to the positioning ring. The guiding pin includes an end slideably received in the guiding groove of the guiding portion of the coupling member, permitting joint sliding movement of the positioning ring and the driving jacket relative to the guiding portion of the coupling member between the engagement position and the disengagement position and avoiding rotational movement of the positioning ring relative to the coupling member.

The rotational sleeve can further include a first compartment extending along the longitudinal axis from an upper end of the rotational sleeve towards but spaced from a lower end of the rotational sleeve. The rotational sleeve can further include a second compartment extending from the lower end of the rotational sleeve but spaced from the first compartment along the longitudinal axis. The umbrella can further include a first bearing mounted in the first compartment and coupled to the axle of the coupling member. The umbrella can further include a second bearing mounted in the second compartment and coupled to the axle of the coupling member. The first and second bearings support rotational movement of the rotational sleeve.

The driving jacket can further include a lip on a lower end thereof. The umbrella can further include a housing fixed around the fixing tube. The housing includes a space defined therein and an opening in communication with the space. The housing further includes an inner wall located in the space and spaced from the opening along the longitudinal axis. The lower end of the driving jacket is slideably received in the space of the housing along the longitudinal axis. When the driving jacket is in the engagement position, the lip of the driving jacket abuts an upper end of the housing. When the driving jacket is in the disengagement position, the lip of the driving jacket is spaced from the upper end of the housing along the longitudinal axis.

The coupling member can further include a passage extending from an end face of a top end of the axle through a bottom face of the coupling portion. The umbrella can further include a guiding sleeve mounted around the axle of the coupling member. The guiding sleeve includes a conical hole intercommunicated with the passage of the coupling member. The guiding sleeve further includes an outer periphery abutting the inner periphery of the movable tube. The umbrella can further include a cable winding device mounted to the fixing tube and including a handle rotatably mounted outside of the fixing tube and a shaft jointly rotatable with the handle. The umbrella can further include a cable having a winding end fixed to the shaft and a pull end fixed to the runner. A portion of the cable is received in the conical hole of the guiding sleeve and the passage of the coupling member. When the runner is in the lower position, rotation of the handle in a first direction causes the cable to be wound around the shaft, and the pull end of the cable pulls the runner to move from the lower position to the upper position. When the runner is in the upper position, rotation of the handle in a second direction opposite to the first direction causes the cable to be released from the shaft, and the runner moves from the upper position to the lower position by gravity.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
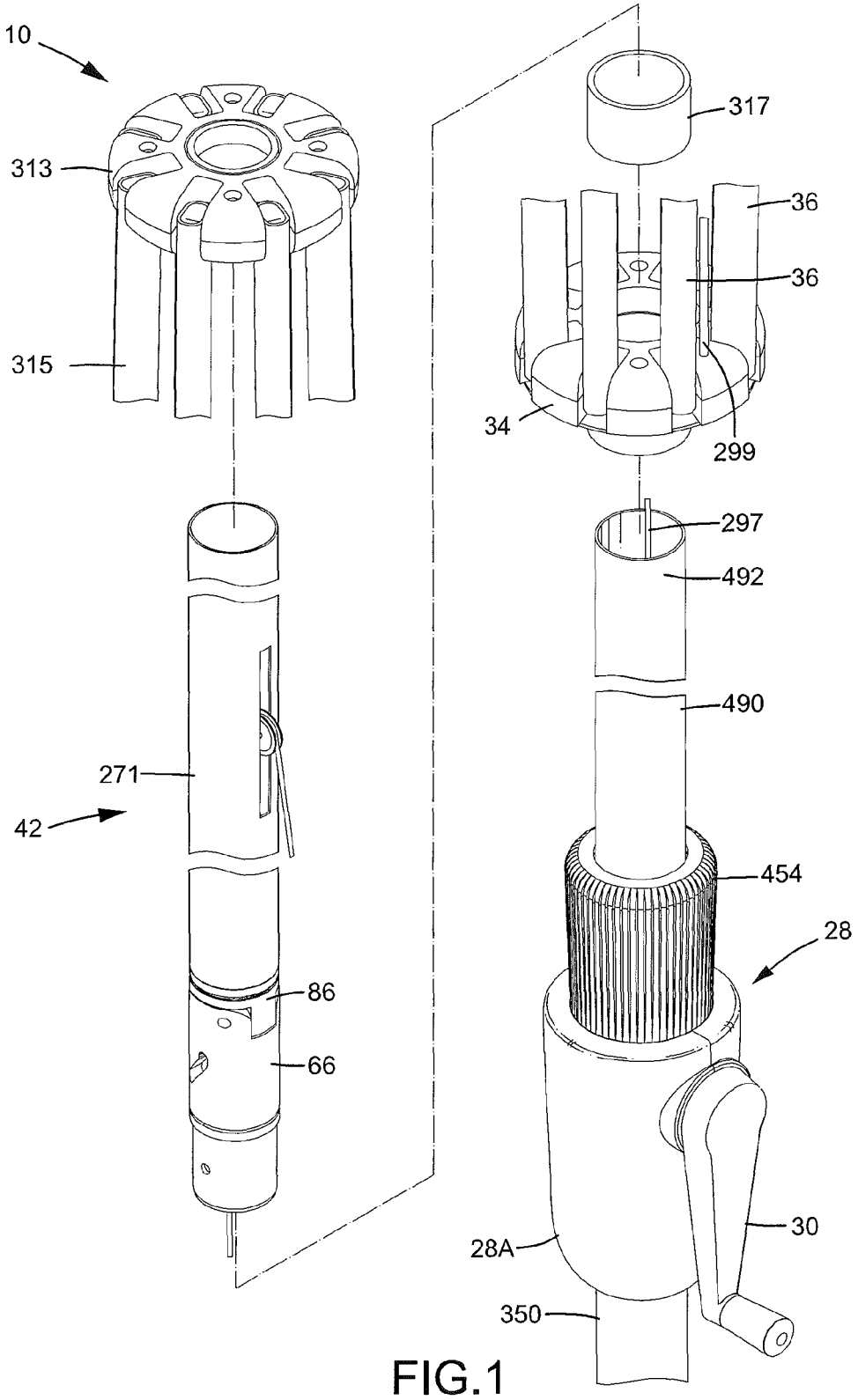
FIG. 1 is an exploded, perspective view of an umbrella according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "lower", "upper", "top", "bottom", "side", "end", "portion", "section", "upright", "tilt", "longitudinal", "circumferential", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

An umbrella according to the present invention is shown in the drawings and generally designated 10. Umbrella 10 includes a fixing tube 350 having a first end 352 and a second end 354 spaced from a longitudinal axis. Fixing tube 350 further includes a longitudinal hole 356 extending from first end 352 through second end 354. Second end 354 of fixing tube 350 can be mounted to a base 357 for supporting fixing tube 350 in an upright position.

Figure 2:
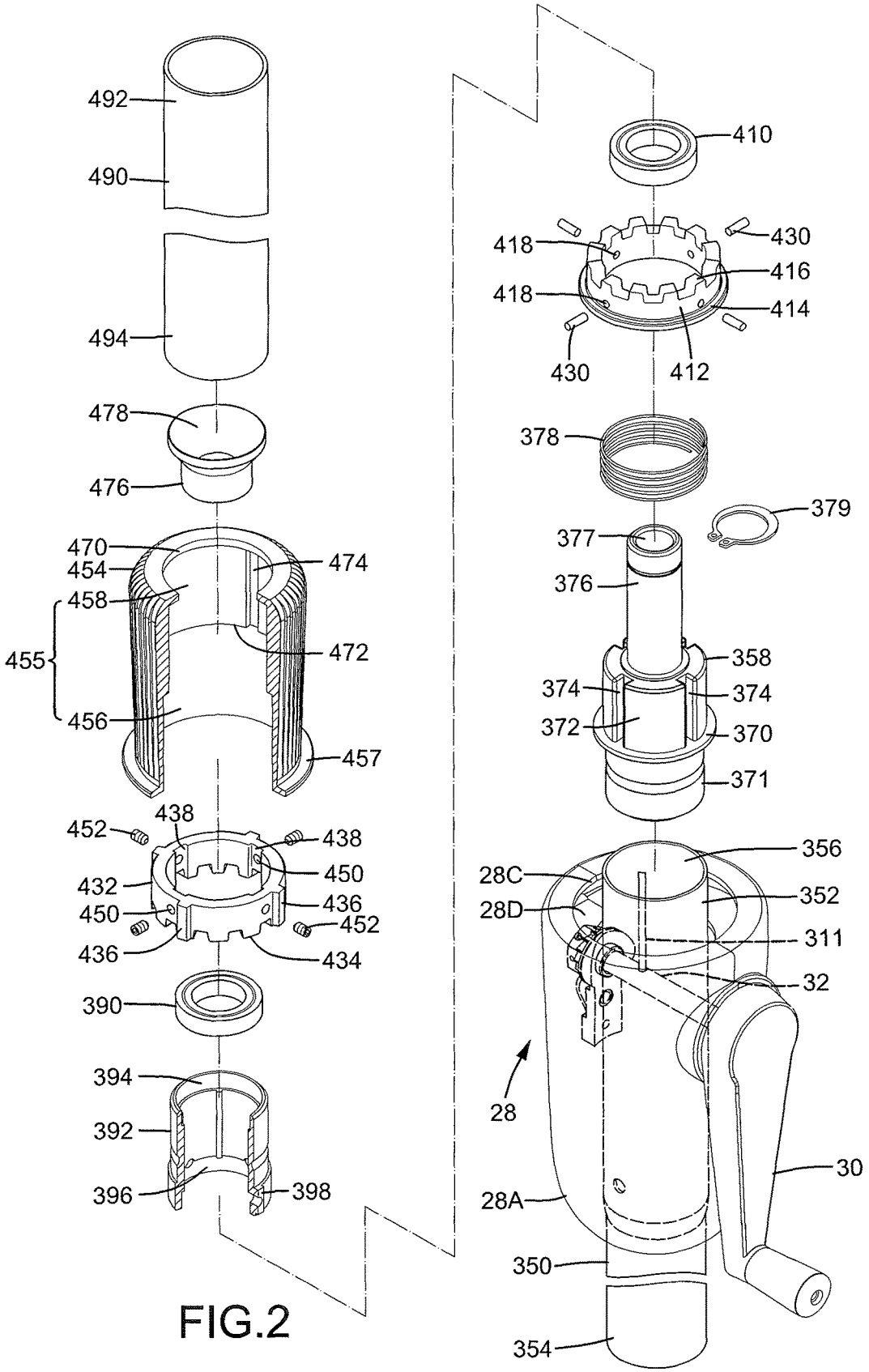
FIG. 2 is a partial, exploded, perspective view of the umbrella of FIG. 1.

Umbrella 10 further includes a cable winding device 28 mounted around fixing tube 350 and located adjacent to first end 352. Specifically, cable winding device 28 includes a housing 28A mounted around fixing tube 350. Housing 28A includes a space 28B defined therein and an opening 28C in communication with the space 28B. Housing 28A further includes an inner wall 28D located in space 28B and spaced from opening 28C along the longitudinal axis. Cable winding device 28 further includes a handle 30 pivotably connected to housing 28A and located outside of housing 28A. A shaft 32 is mounted in housing 28A and is fixed to handle 30 to permit joint rotation of shaft 32 and handle 30 (see FIG. 2). Handle 30 is pivotably connected to fixing tube 350. First end 352 of fixing tube 350 extends beyond housing 28A via opening 28C. A cable 297 includes a pull end 299 and a winding end 311 coupled to shaft 32. Clockwise or counterclockwise rotation of handle 30 causes cable 297 to be wound around or released from shaft 32. Furthermore, longitudinal hole 356 of fixing tube 350 receives cable 297.

Umbrella 10 further includes a coupling member 358 fixed to fixing tube 350. Coupling member 358 includes a separation portion 370, a coupling portion 371 formed on a bottom side of separation portion 370 and extending along the longitudinal axis, and a guiding portion 372 formed on a top side of separation portion 370 and extending along the longitudinal axis. Guiding portion 372 includes four guiding groove 374 formed on an outer periphery thereof and spaced from each other by regular angular intervals in a circumferential direction about the longitudinal axis. Coupling member 358 further includes an axle 376 formed on an upper end of guiding portion 372, extending along the longitudinal axis, and having a diameter smaller than a diameter of guiding portion 372. Coupling member 358 further includes a passage 377 extending from an end face of a top end of axle 376 through a bottom face of coupling portion 371. Coupling portion 371 is fixed to first end 352 of fixing tube 350. Guiding portion 372 of coupling member 358 abuts an end face of first end 352 of fixing tube 350.

Umbrella 10 further includes a positioning ring 412 slideably mounted around coupling member 358. Positioning ring 412 includes a protrusion 414 formed on an outer periphery thereof and a fixing toothed portion 416 formed on an upper end thereof. Fixing toothed portion 416 includes a plurality of teeth. Positioning ring 412 further includes four fixing holes 418 spaced from each other by regular angular intervals in the circumferential direction about the longitudinal axis. Positioning ring 412 is mounted around guiding portion 372 of coupling member 358. Each fixing hole 418 is aligned with one of guiding grooves 374. A guiding pin 430 is engaged in each fixing hole 418. An end of each guiding pin 430 is slideably received in one of guiding grooves 374 of coupling member 358 (see FIG. 6). Thus, positioning ring 412 cannot rotate relative to coupling member 358 but can slide along the longitudinal axis.

Umbrella 10 further includes a rotational sleeve 392 rotatably mounted to axle 376. Rotational sleeve 392 includes a first compartment 394 extending from an upper end of rotational sleeve 392 towards but spaced from a lower end of rotational sleeve 392 along the longitudinal axis. Rotational sleeve 392 further includes a second compartment 396 extending from the lower end of rotational sleeve 392 towards but spaced from first compartment 394 along the longitudinal axis. Rotational sleeve 392 further includes four engagement blocks 398 formed on an outer periphery thereof and aligned with second compartment 396. Engagement blocks 398 are spaced from each other by regular angular intervals in the circumferential direction about the longitudinal axis.

Figure 4:
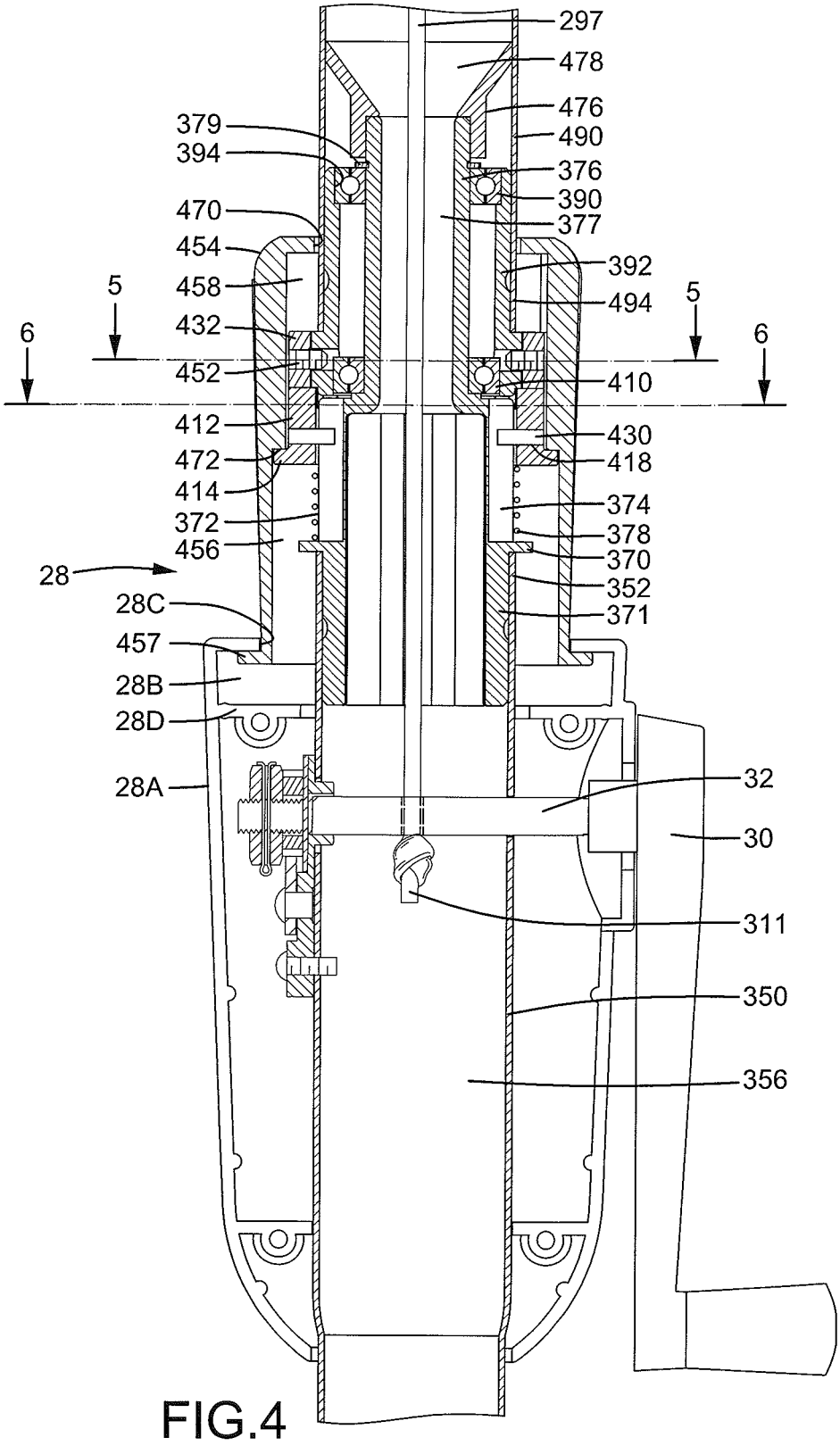
FIG. 4 is a cross sectional view taken along section line 4-4 of FIG. 3.

Rotational sleeve 392 is mounted around axle 376 of coupling member 358. First compartment 394 of rotational sleeve 392 receives a first bearing 390 rotatably coupled to axle 376. Second compartment 396 receives a second bearing 410 (FIG. 4). First bearing 390 and second bearing 410 support rotational sleeve 392 to rotate about the longitudinal axis. Furthermore, positioning ring 412 is located between rotational sleeve 392 and separation portion 370 of coupling member 358 along the longitudinal axis. Furthermore, a retaining ring 379 is mounted around axle 376 and below a guiding sleeve 476. Retaining ring 379 prevents first bearing 390 from disengaging from first compartment 394 of rotational sleeve 392 through movement along the longitudinal axis.

Umbrella 10 further includes a connecting ring 432 having four actuating blocks 436 on an outer periphery thereof. Actuating blocks 436 are spaced from each other by regular angular intervals in the circumferential direction about the longitudinal axis. Connecting ring 432 further includes four engagement grooves 438 in an inner periphery thereof. Engagement grooves 438 are spaced from each other by regular angular intervals in the circumferential direction about the longitudinal axis. Connecting ring 432 further includes four pin holes 450. Each pin hole 450 extends from a wall of one of engagement grooves 438 through the outer periphery of connecting ring 432. A connecting toothed portion 434 is formed on a lower end of connecting ring 432 and includes a plurality of teeth.

Figure 5:
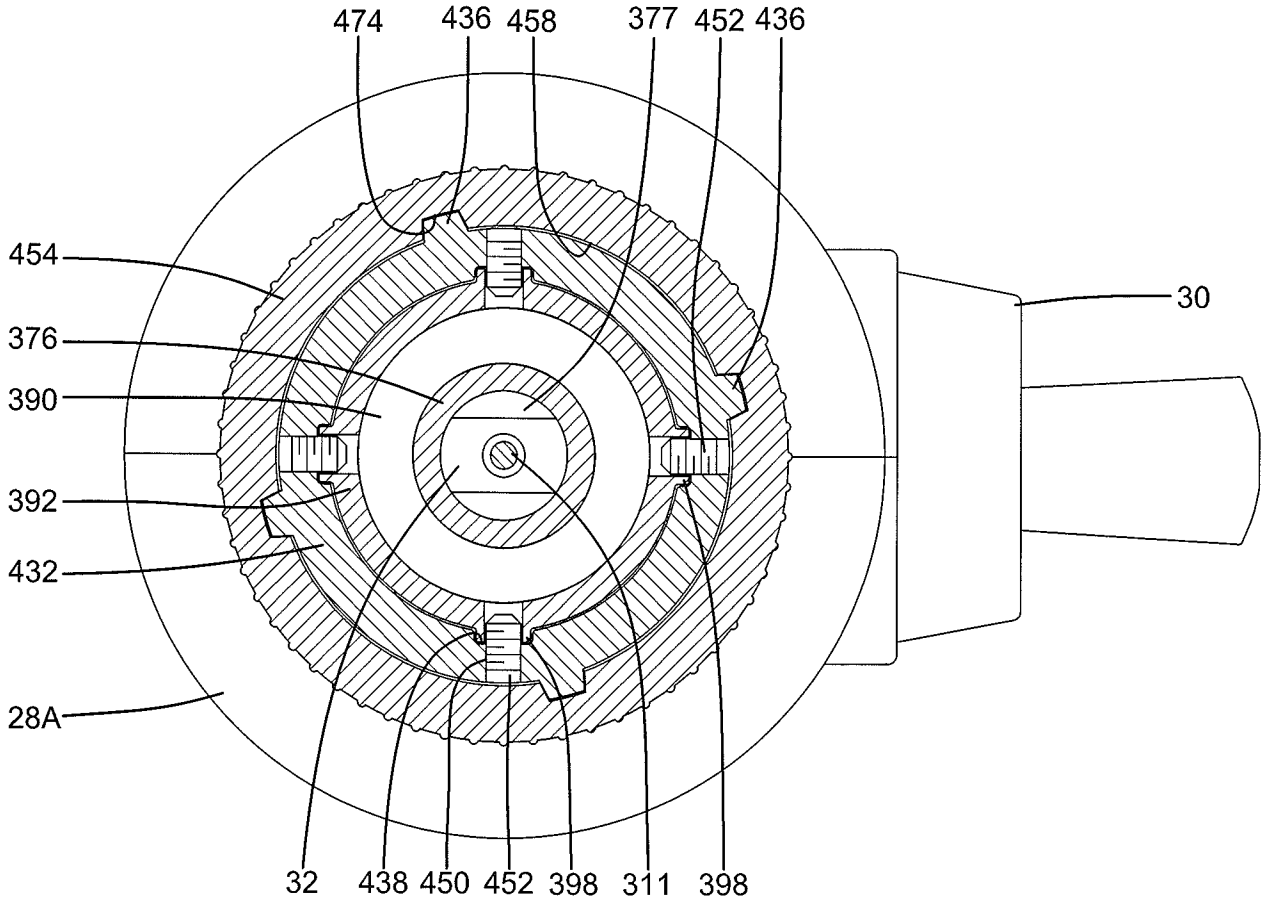
FIG. 5 is a cross sectional view taken along section line 5-5 of FIG. 4.

Connecting ring 432 is mounted around rotational sleeve 392. Each engagement groove 438 of connecting ring 432 is engaged with one of engagement blocks 398 of rotational sleeve 392. A pin 452 extends through one of engagement blocks 398 and one of pin holes 450 of positioning ring 412, preventing connecting ring 432 from rotating relative to rotational sleeve 392 (see FIG. 5).

Umbrella 10 further includes a driving jacket 454 mounted around connecting ring 432. Driving jacket 454 includes a chamber 455 defined therein. Chamber 455 includes a first section 456 extending from a bottom thereof towards but spaced from a top end thereof along the longitudinal axis. Chamber 455 further includes a second section 458 extending from a top end thereof to first section 456 along the longitudinal axis and having a diameter smaller than a diameter of first section 456, forming a pressing face 472 at the intersection between the first and second sections 456 and 458. Four actuating grooves 474 are defined in an inner periphery of second section 458 and are spaced from each other by regular angular intervals in the circumferential direction about the longitudinal axis. Driving jacket 454 further includes an opening 470 extending from the top end of driving jacket 454 to second section 458 along the longitudinal axis. Driving jacket 454 further includes a lip 457 on the lower end thereof.

Lip 457 of driving jacket 454 is slideably received in space 28B of housing 28A. Connecting ring 432 is received in second section 458 of driving jacket 454. Each actuating block 436 is slideably engaged in one of actuating grooves 474 of driving jacket 454 (see FIGS. 4 and 5). Thus, driving jacket 454 is slideable between an engagement position (FIG. 4) and a disengagement position (FIG. 5) along the longitudinal axis. Furthermore, protrusion 414 of positioning ring 412 is located in first section 456 of driving jacket 454, such that driving jacket 454 and positioning ring 412 are jointly moveable between the engagement position and the disengagement position. When driving jacket 454 is not subjected to any external force, spring 378 biases positioning ring 412 and driving jacket 454 to the engagement position. Furthermore, inner wall 28D of housing 28A prevents driving jacket 454 from moving beyond the disengagement position in a direction away from the engagement position.

Guiding sleeve 476 has a conical hole 478 and is mounted on the top end of axle 376 of coupling member 358. Conical hole 478 of guiding sleeve 476, passage 377 of coupling member 358, and longitudinal hole 356 of fixing tube 350 are aligned with each other along the longitudinal axis (FIG. 4).

Umbrella 10 further includes a movable tube 490 coupled to rotational sleeve 392. Movable tube 490 includes an upper end 492 and a lower end 494 spaced from upper end 492 along the longitudinal axis. Lower end 494 of movable tube 490 is coupled to and not rotatable relative to rotational sleeve 392, such that movable tube 490 and rotational sleeve 392 are jointly rotatable about the longitudinal axis. An upper end of guiding sleeve 476 abuts an inner periphery of movable tube 490. When mounting winding end 311 of cable 297, conical hole 478 of guiding sleeve 476 permits winding end 311 of cable 297 passing therethrough to automatically align with passage 377 of coupling member 358, which is advantageous to couple winding end 311 of cable 297 with shaft 32 of cable winding device 28.

Figure 9:
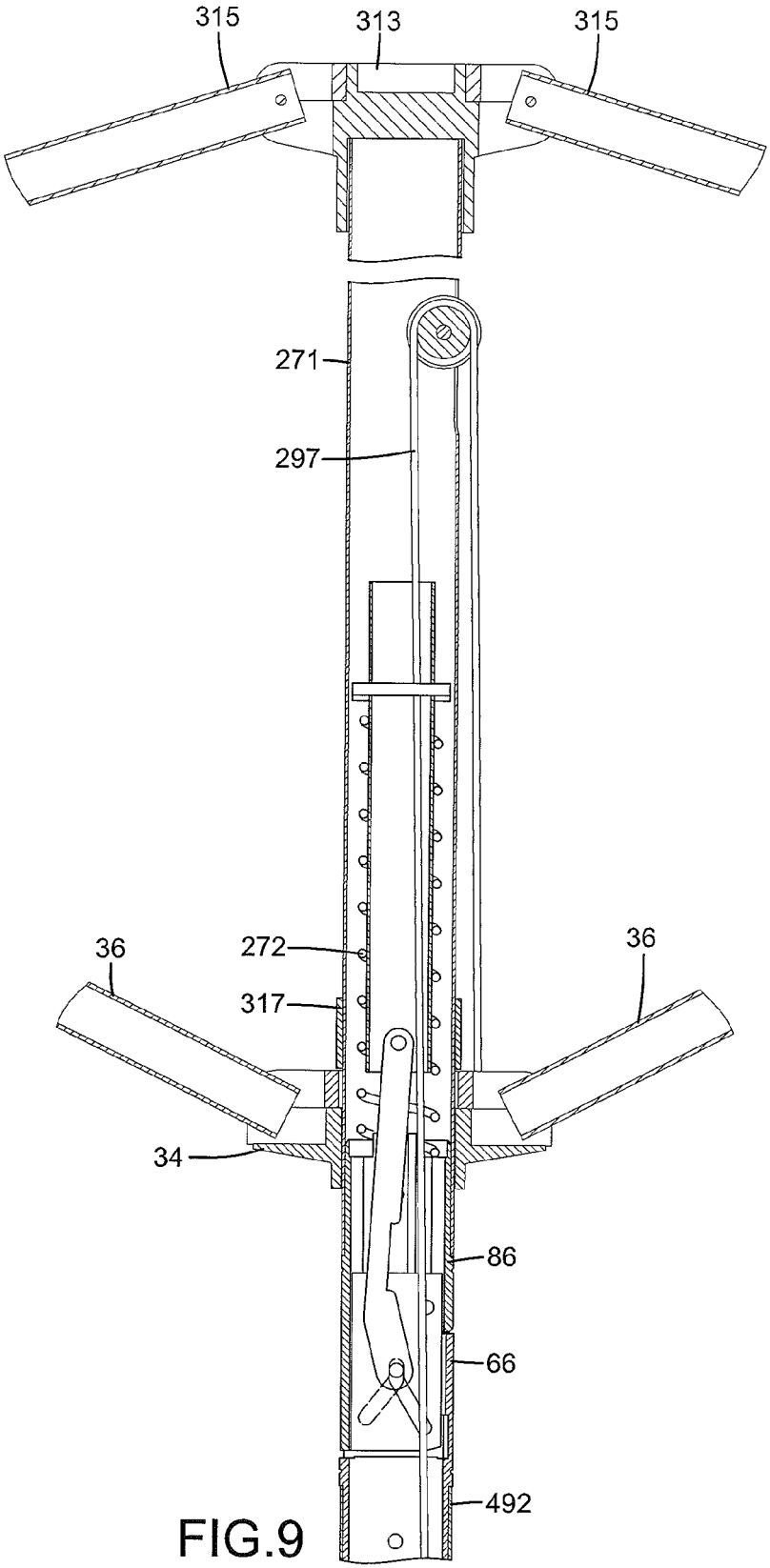
FIG. 9 is a cross sectional view taken along section line 9-9 of FIG. 8.
Figure 10:
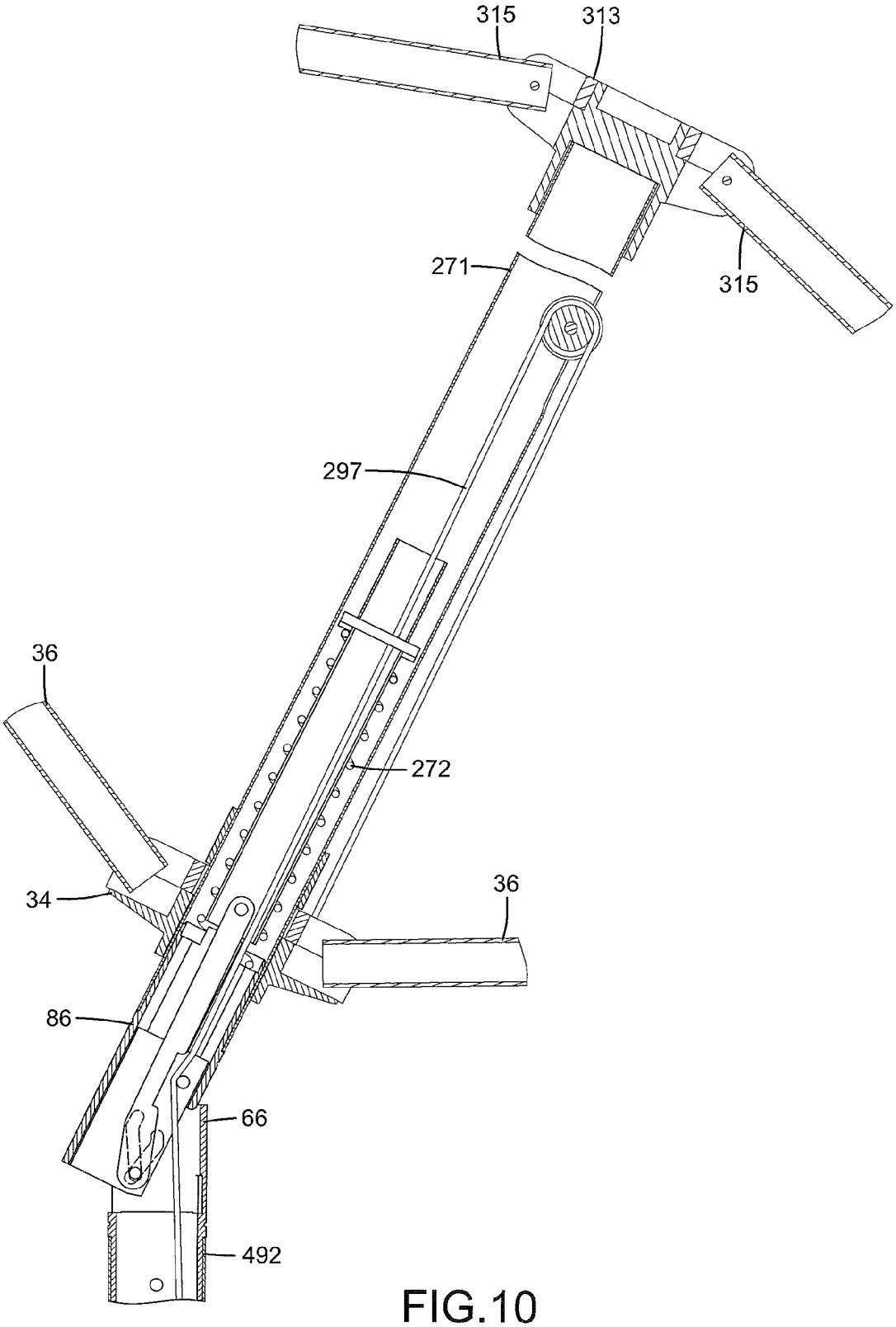
FIG. 10 is a view similar to FIG. 9, with a tilt member in a tilt position.

Umbrella 10 further includes a canopy operating device 42 mounted to movable tube 490. Canopy operating device 42 includes a rotational member 66 fixed to upper end 492 of movable tube 490 and a tilt member 86 pivotably connected to rotational member 66. Canopy operating device 42 further includes an extension rod 271 having a lower end fixed to tilt member 86 and a stop ring 317 fixed to an outer periphery of extension rod 271. Tilt member 86 can be controlled to pivot between an upright position (FIGS. 7 and 9) and a tilt position (FIG. 10). Examples of detailed structure of canopy operating device 42 movable between the upright position and the tilt position are disclosed in U.S. Pat. Nos. 4,878,509; 8,522,804; 8,534,304; 8,763,620; and 8,899,250, the entire contents of which are incorporated herein by reference. It can be appreciated that other types of canopy operating devices 42 movable between the upright position and the tilt position can be used.

Umbrella 10 further includes a rib hub 313 fixed on an upper end of extension rod 271 and a plurality of ribs 315 pivotably connected to rib hub 313. Rib hub 313, ribs 315, and tilt member 86 are jointly moveable between the tilt position and the upright position. A canopy 319 is mounted to ribs 315.

Figure 3:
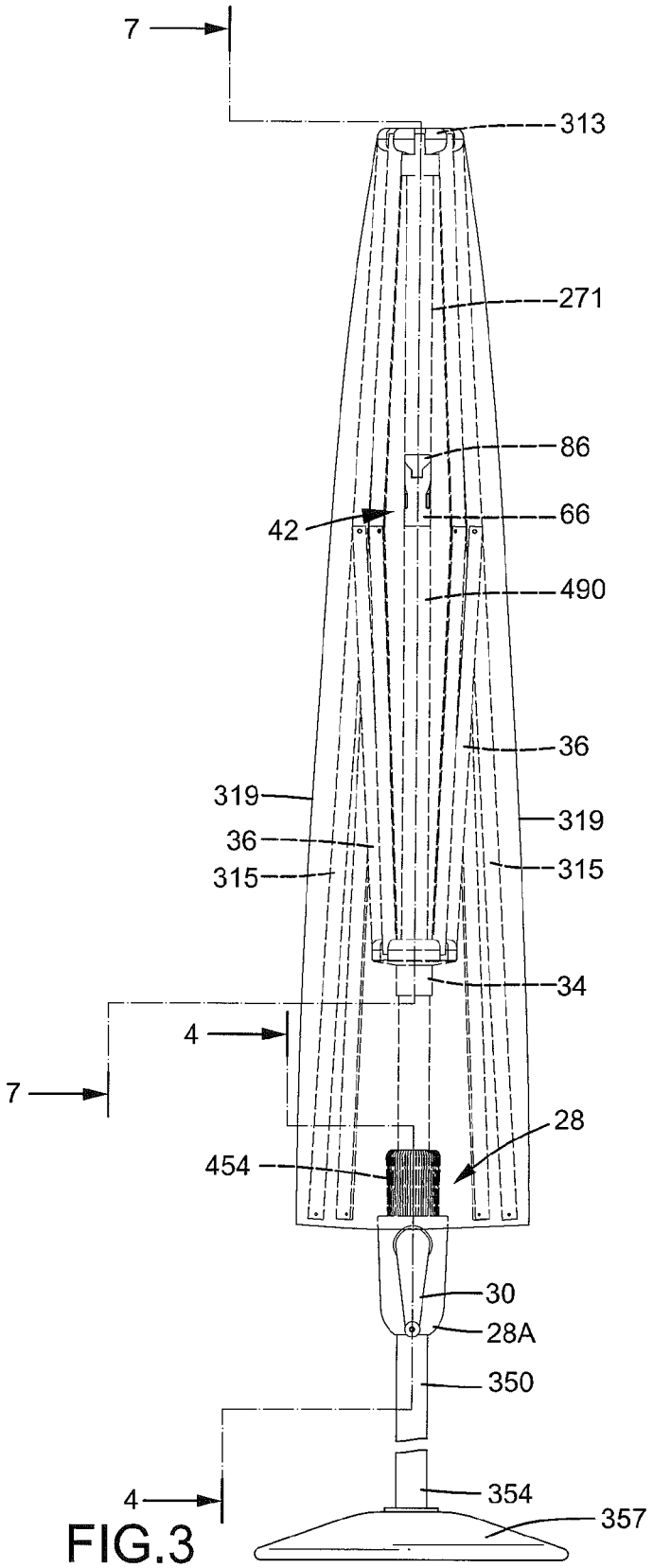
FIG. 3 is a diagrammatic side view of the umbrella of FIG. 1 in a folded state.
Figure 7:
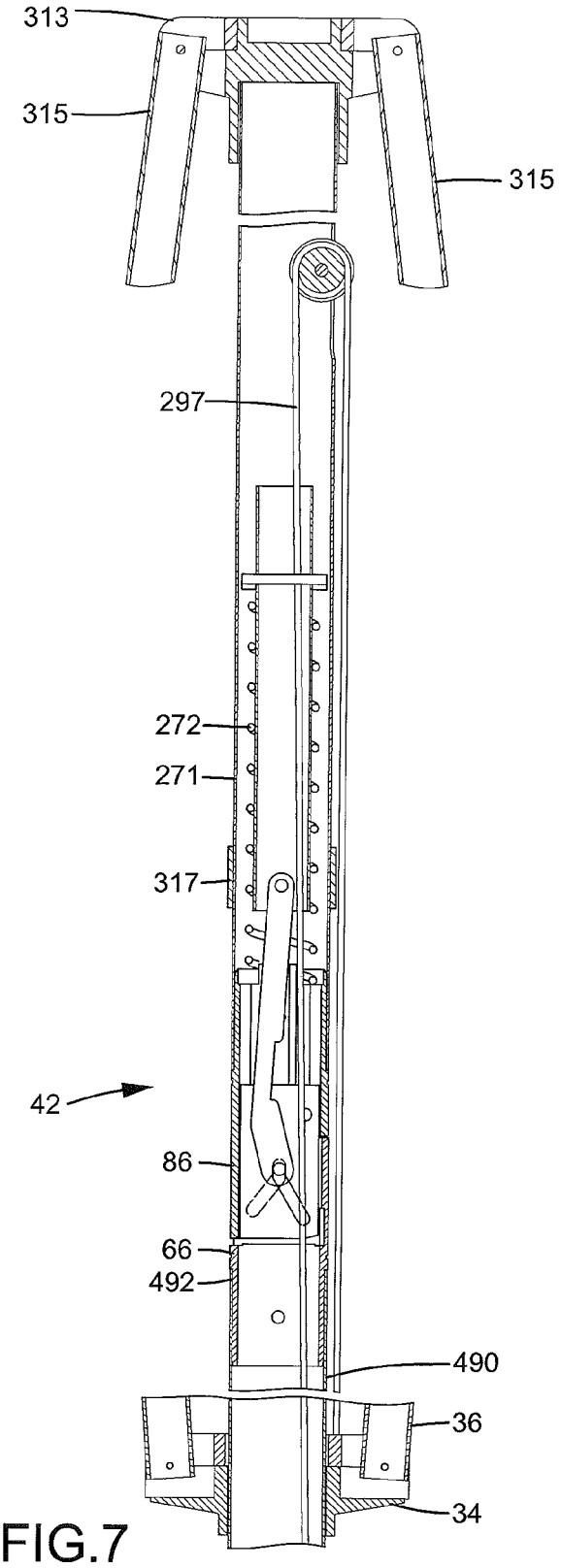
FIG. 7 is a cross sectional view taken along section line 7-7 of FIG. 3.

Umbrella 10 further includes a runner 34 slideably mounted around canopy operating device 42. An end of each of a plurality of stretchers 36 is pivotably connected runner 34. The other end of each stretcher 36 is pivotably connected to one of ribs 315. Runner 34 is slideable between an upper position (FIGS. 8 and 9) and a lower position (FIGS. 3 and 7) along the longitudinal axis. When runner 34 is in the lower position, runner 34 is located about movable tube 490 (FIGS. 3 and 7). Pull end 299 of cable 297 is fixed on runner 34. Thus, when handle 30 is rotated in a first direction (such as the clockwise direction) to wind cable 297 around shaft 32, runner 34 is pulled by cable 297 to move from the lower position to the upper position. When handle 30 is rotated in a second direction (such as the counterclockwise direction) opposite to the first direction to release cable 297 from shaft 32, runner 34 moves downward to the lower position by gravity.

Figure 6:
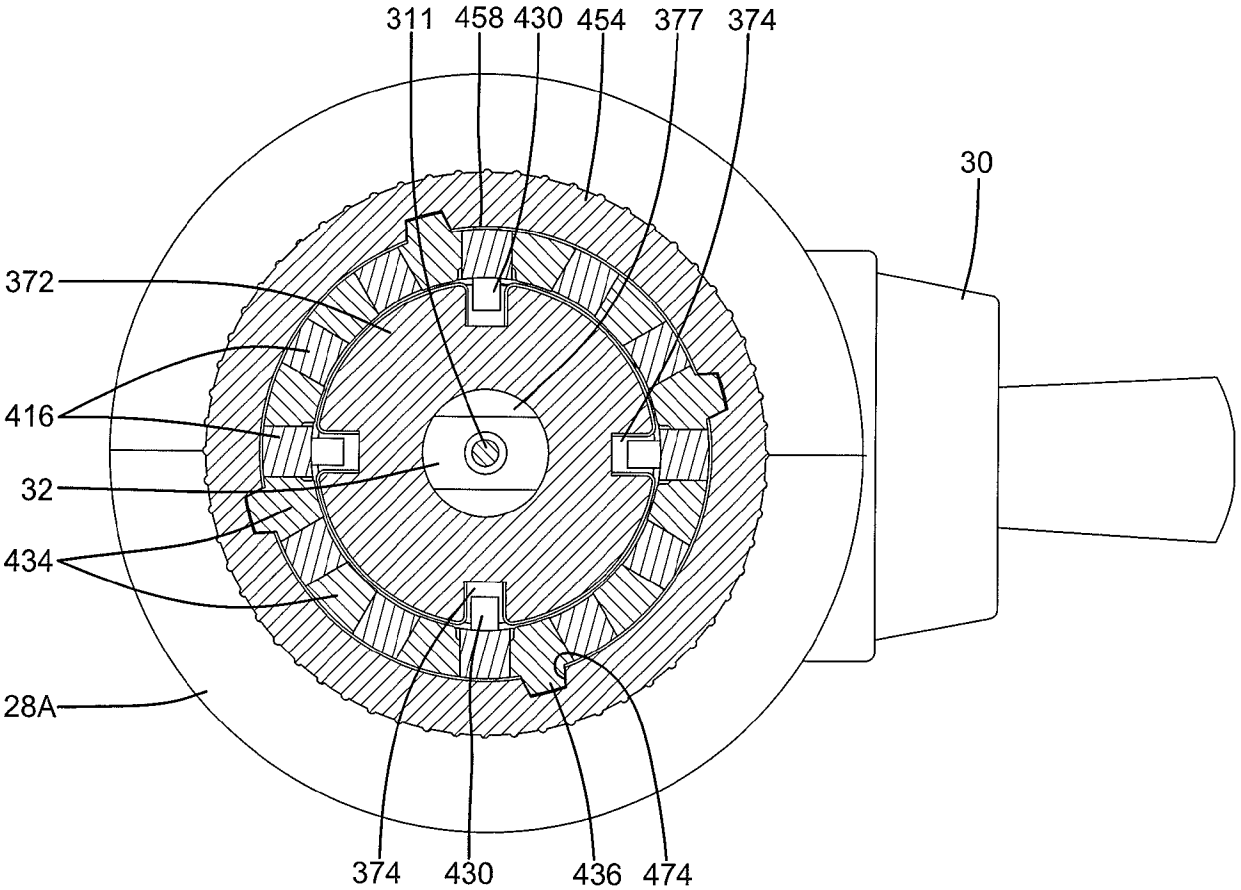
FIG. 6 is a cross sectional view taken along section line 6-6 of FIG. 4.

Now that the basic construction of umbrella 10 has been explained, the operation and some of the advantages of the umbrella 10 can be set forth and appreciated. In particular, for the sake of explanation, it will be assumed that runner 34 is in the lower position (FIGS. 3 and 7), tilt member 86 is in the upright position (FIG. 7), and driving jacket 454 is in the engagement position (FIG. 4). In this state, extension rod 271 and movable tube 490 are located on the same straight line. Each stretcher 36 is located adjacent to extension rod 271, such that ribs 315 are in a collapsed state and such that canopy 319 is not stretched and, thus, not opened (FIG. 3). Fixing toothed portion 416 of positioning ring 412 engages with connecting toothed portion 434 of connecting ring 432 (FIG. 6). Thus, rotational sleeve 392, driving jacket 454, movable tube 490, canopy operating device 42, rib hub 313, and runner 34 cannot rotate about the longitudinal axis of fixing tube 350, and umbrella 10 is in the collapsed state.

Figure 8:
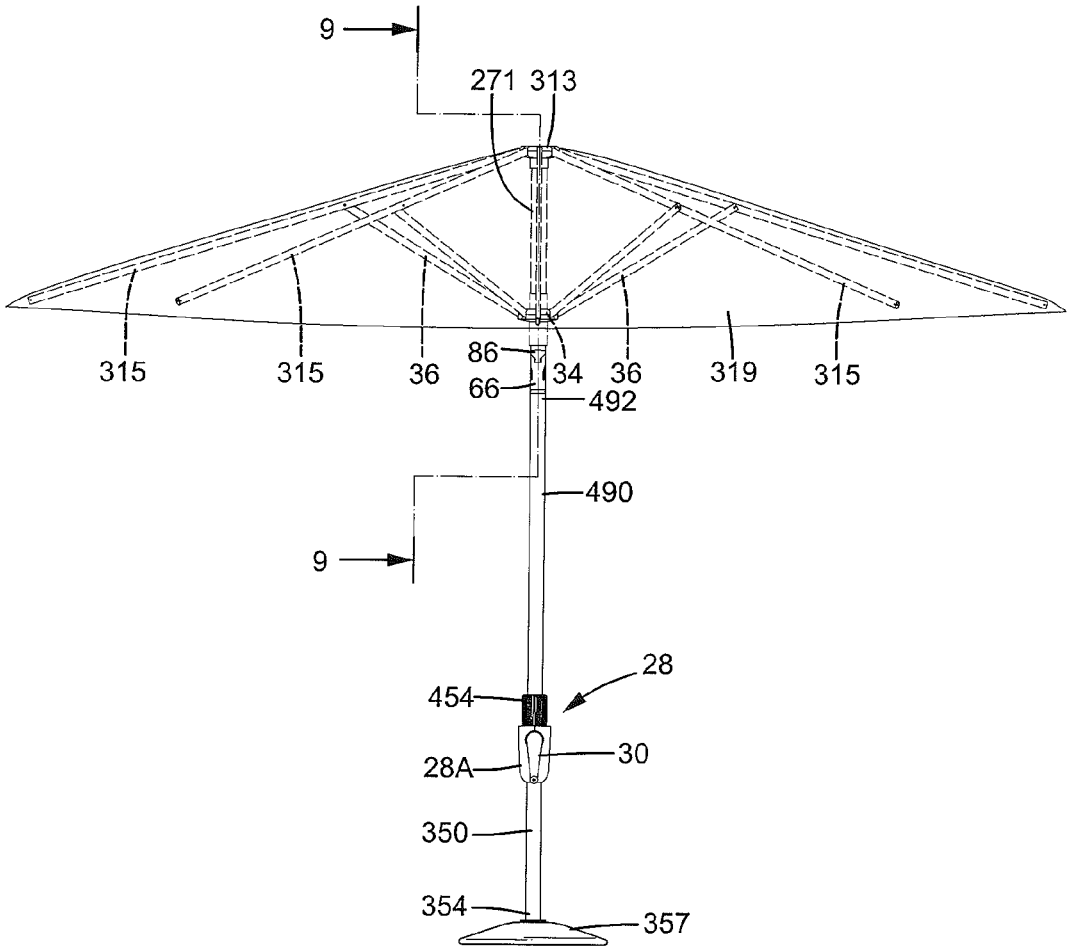
FIG. 8 is a diagrammatic side view of the umbrella of FIG. 1 in an open state.

When runner 34 is in the lower position, handle 30 can be rotated clockwise to wind cable 297 around shaft 32, and pull end 299 moves runner 34 from the lower position to the upper position. Furthermore, each stretcher 36 and its associated rib 315 move away from extension rod 271 to stretch open canopy 319. Runner 34 in the upper position is located around extension rod 271 and abuts a lower end of stop ring 317. Canopy 319 is stretched open by ribs 315 (FIGS. 8 and 9). Thus, umbrella 10 is in an open state.

When runner 34 is in the upper position, further rotation of handle 30 in the clockwise direction further winds cable 297 around shaft 32, but runner 34 cannot move upward towards rib hub 313. Thus, tilt member 86 pivots from the upright position (FIG. 9) to the tilt position (FIG. 10) relative to rotational member 66, such that rib hub 313, runner 34, and extension rod 271 pivot to the tilted position. As a result, umbrella 10 is in the tilt state.

Figure 11:
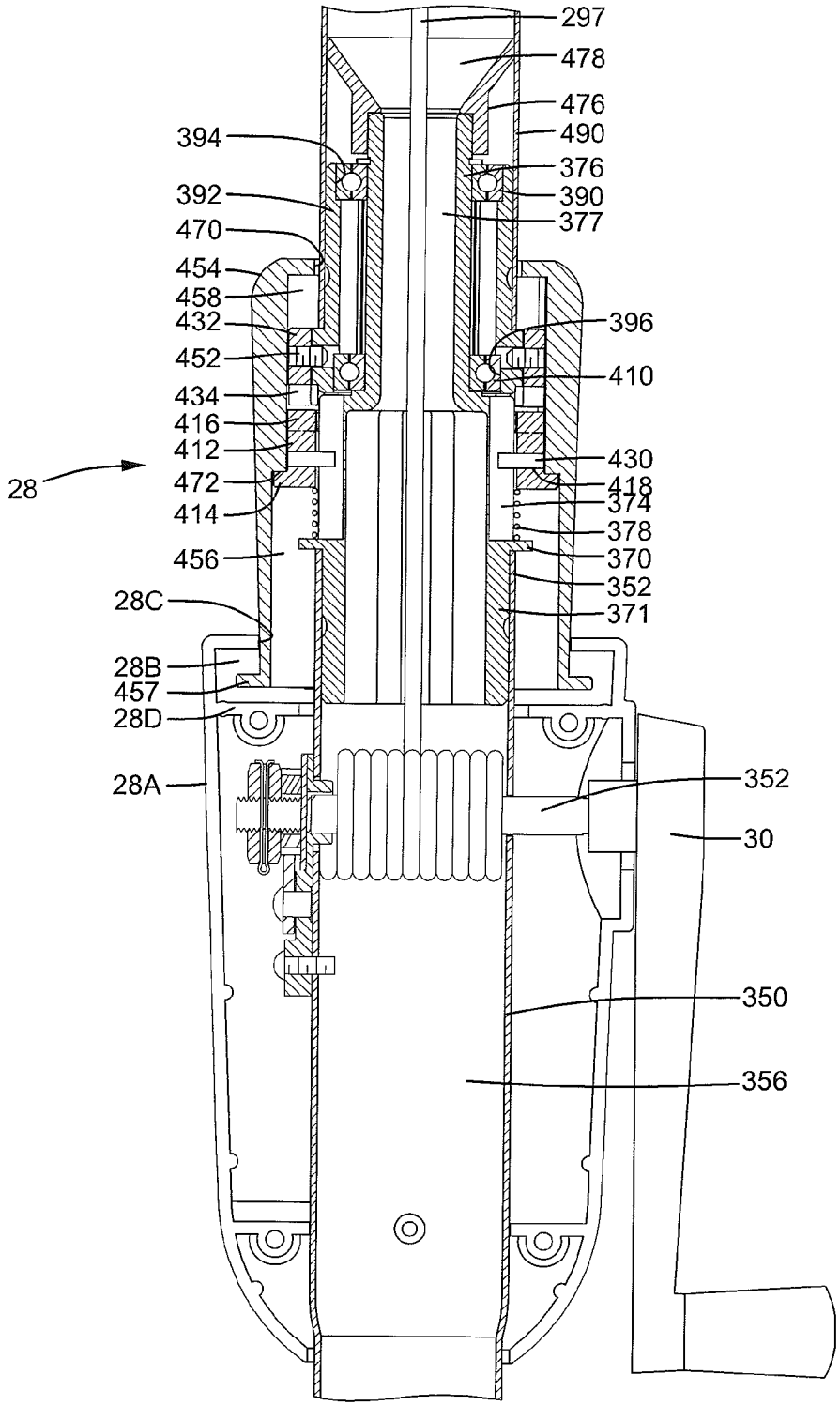
FIG. 11 is a view similar to FIG. 4, with a driving jacket moved from an engagement position to a disengagement position.
Figure 12:
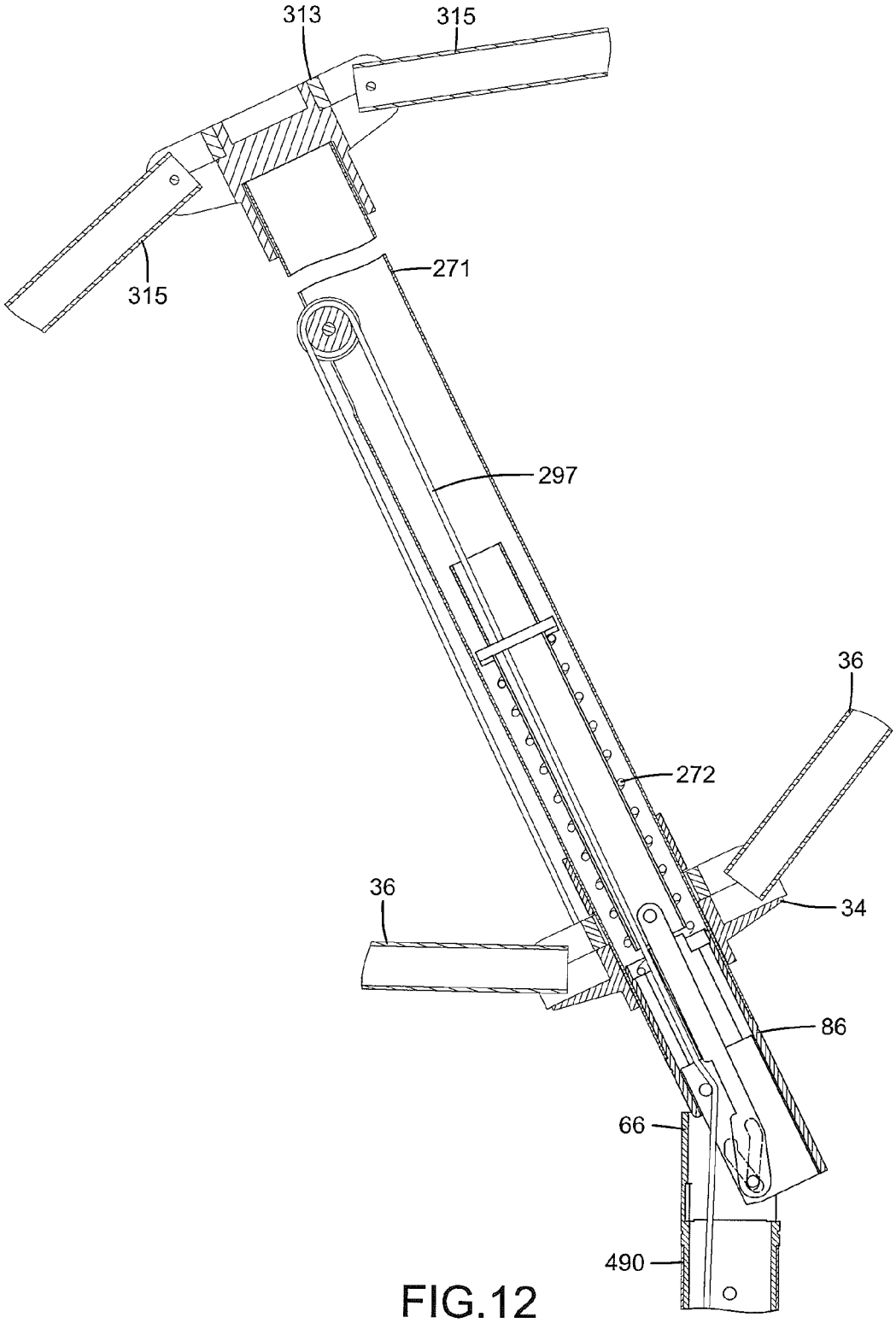
FIG. 12 is a view similar to FIG. 10, with the umbrella of FIG. 1 rotated 180°.

If canopy 319 of umbrella 10 in the tilt state cannot provide the desired shielding effect, umbrella 10 can be pivoted to move canopy 319 to a position facing the sun for a better shielding effect. Specifically, driving jacket 454 is moved from the engagement position (FIGS. 4 and 6) to the disengagement position (FIG. 11). Pressing face 472 of driving jacket 454 abuts protrusion 414 of positioning ring 412, such that positioning ring 412 moves towards guiding portion 372 of coupling member 358 along the longitudinal axis and compresses spring 378, causing disengagement of fixing toothed portion 416 of positioning ring 412 from connecting toothed portion 434 of connecting ring 432. Thus, connecting ring 432 is not restricted by the non-rotatable positioning ring 412, permitting connecting ring 432, rotational sleeve 392, driving jacket 454, movable tube 490, canopy operating device 42, rib hub 313, runner 314, and canopy 319 to pivot about the longitudinal axis. FIG. 12 shows that driving jacket 454 is operated to rotate umbrella 10 180° (cf. FIG. 10). It can be appreciated that canopy 319 of umbrella 10 can be rotated to any desired orientation facing the sun to provide a better shielding effect.

After canopy 319 of umbrella 10 is rotated to any desired orientation, driving jacket 454 is released, and spring 378 biases positioning ring 412. Protrusion 414 of positioning ring 412 presses against pressing face 472 of driving jacket 454, moving driving jacket 454 from the disengagement position to the engagement position. Furthermore, fixing toothed portion 416 of positioning ring 412 engages with connecting toothed portion 434 of connecting ring 432 (FIG. 4), fixing canopy 319 in the desired orientation (FIG. 12).

If it is desired to collapse canopy 319 of umbrella 10, handle 30 is rotated in the counterclockwise rotation to release cable 297 from shaft 32. Tilt member 86 is biased by a spring 272 (FIG. 12) to move from the tilt position to the upright position. After tilt member 86 reaches the upright position, further counterclockwise rotation of handle 30 causes further release of cable 297. Runner 34 moves downward from the upper position to the lower position under gravity, gradually collapsing canopy 319. After runner 34 reaches the lower position, canopy 319 completely collapses.

After canopy 319 is opened and tilted, driving jacket 454 can be operated to rotate canopy 319 about the longitudinal axis to an orientation facing the sun, providing the user with a better shielding effect. Furthermore, the mechanism for rotating canopy 319 is simplified to save the time and cost for assembly and manufacture.

Furthermore, conical hole 478 of guiding sleeve 476 and abutment of the outer periphery of guiding sleeve 476 against the inner periphery of movable tube 490 are advantageous to guide winding end 311 of cable 297 through conical hole 478 of guiding sleeve 476 and then passage 377 of coupling member 358, saving the time for fixing winding end 311 of cable 297 onto shaft 32.

Now that the basic teachings of the present invention have been explained, many extensions and variations will be obvious to one having ordinary skill in the art. For example, guiding portion 372 of coupling member 358 does not have to include guiding grooves 374. In this case, guiding portion 372 of coupling member 358 can have polygonal (such as hexagonal) cross sections, and the inner periphery of positioning ring 412 can have corresponding polygonal cross sections. Thus, even though guiding grooves 374 and guiding pins 430 are not provided, positioning ring 412 cannot rotate relative to coupling member 358 but can slide relative to coupling member 358 along the longitudinal axis. Connecting ring 432 can include fewer actuating blocks 436 (such as only one actuating block 436), and driving jacket 454 can include fewer actuating grooves 474 (such as only one actuating groove 474), connecting ring 432 can include fewer engagement grooves 438 (such as only one engagement groove 438), and rotational sleeve 392 can include fewer engagement blocks 398 (such as only one engagement block 398). Furthermore, umbrella 10 can include fewer guiding pins 430 (such as only one guiding pin 430) and fewer pins 452 (such as only one pin 452).

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An umbrella comprising:

a fixing tube including first and second ends spaced from each other along a longitudinal axis;

a coupling member including a coupling portion and a guiding portion extending along the longitudinal axis and having an upper end, with an axle extending from the upper end of the guiding portion and extending along the longitudinal axis, with the coupling portion of the coupling member fixed to the first end of the fixing tube;

a positioning ring mounted around the coupling member, with the positioning ring including an upper end having a fixing toothed portion, and with the positioning ring mounted to and not rotatable relative to the guiding portion of the coupling member;

a spring mounted around the guiding portion of the coupling member, with the spring biasing the positioning ring towards the axle;

a rotational sleeve rotatably mounted to the axle of the coupling member;

a connecting ring fixed to an outer periphery of the rotational sleeve, with the connecting ring including a lower end having a connecting toothed portion, and with the connecting ring and the rotational sleeve jointly rotatable about the longitudinal axis;

a driving jacket including a chamber, with the connecting ring received in the chamber, with the positioning ring received in the chamber and rotatable relative to driving jacket, with the driving jacket movable along the longitudinal axis between an engagement position in which the positioning ring engages with the connecting ring and a disengagement position in which the positioning ring disengages from the connecting ring, and with the driving jacket, the connecting ring, and the rotational sleeve jointly rotatable about the longitudinal axis;

a movable tube including a lower end located around the rotational sleeve and an upper end located around the driving jacket and spaced from the lower end along the longitudinal axis, with the movable tube and the rotational sleeve jointly rotatable about the longitudinal axis;

a canopy operating device including a rotational member fixed to the upper end of the movable tube and a tilt member pivotably connected to the rotational member, with the canopy operating device further including an extension rod having a lower end fixed to the tilt member and an upper end, with the tilt member and the extension rod pivotable relative to the rotational member between an upright position and a tilt position;

a rib hub fixed to the upper end of the extension rod;

a plurality of ribs, with each of the plurality of ribs having an end pivotably connected to the rib hub;

a runner slideably mounted around the canopy operating device and moveable along the canopy operating device between an upper position and a lower position;

a plurality of stretchers, with each of the plurality of stretchers including a first end pivotably connected to the runner and a second end pivotably connected to one of the plurality of ribs, wherein with the tilt member in the upright position, the extension rod, the fixing tube, and the movable tube are located on a same straight line, permitting the runner to move between the upper position and the lower position, wherein with the tilt member in the tilt position, the extension rod is tilted relative to the fixing tube and the movable tube, wherein with the runner in the lower position, the tilt member is not permitted to pivot from the upright position to the tilt position, and each of the plurality of stretchers is located adjacent to the extension rod to collapse the plurality of ribs, wherein with the runner in the upper position, the tilt member is permitted to pivot from the upright position to the tilt position, and each of the plurality of stretchers is spaced from the extension rod to stretch open the plurality of ribs, wherein with the driving jacket in the engagement state, the fixing toothed portion of the positioning ring engages with the connecting toothed portion of the connecting ring, avoiding the connecting ring, the rotational sleeve, the driving jacket, and the canopy operating device from pivoting about the longitudinal axis, wherein with the driving jacket in the disengagement state, the fixing toothed portion of the positioning ring disengages from the connecting toothed portion of the connecting ring, permitting the connecting ring, the rotational sleeve, the driving jacket, and the canopy operating device from pivoting about the longitudinal axis, and wherein with the runner in the upper position and with the tilt member in the tilt position, the driving jacket is operable to change an orientation of the rib hub.

2. The umbrella as claimed in claim 1, with the connecting ring further including an actuating block formed on an outer periphery and an engagement groove in an inner periphery thereof, with the driving jacket further including an actuating groove in an inner periphery of the chamber, with the rotational sleeve including an engagement block on an outer periphery thereof, with the actuating block of the connecting ring slideably received in the actuating groove of the driving jacket, permitting joint rotation of the driving jacket and the actuating block about the longitudinal axis and permitting the driving jacket to slide relative to the connecting ring along the longitudinal axis, and with the engagement block of the rotational sleeve securely engaged in the engagement groove of the connecting ring, permitting joint rotational movement of the rotational sleeve and the connecting ring about the longitudinal axis.

3. The umbrella as claimed in claim 1, with the chamber of the driving jacket including a first section extending from a bottom thereof and a second section extending from a top end thereof to the first section and having a diameter smaller than a diameter of the first section, with a pressing face formed at an intersection between the first and second sections, with the driving jacket further including an actuating groove in an inner periphery thereof, with the positioning ring further including a protrusion on an outer periphery thereof, and with the protrusion pressing against the pressing face of the driving jacket to move the driving jacket and the positioning ring between the engagement position and the disengagement position.

4. The umbrella as claimed in claim 1, with the coupling member further including a guiding groove in an outer periphery of the guiding portion, with the umbrella further comprising:

a guiding pin mounted to the positioning ring, with the guiding pin including an end slideably received in the guiding groove of the guiding portion of the coupling member, permitting joint sliding movement of the positioning ring and the driving jacket relative to the guiding portion of the coupling member between the engagement position and the disengagement position and avoiding rotational movement of the positioning ring relative to the coupling member.

5. The umbrella as claimed in claim 1, with the rotational sleeve further including a first compartment extending along the longitudinal axis from an upper end of the rotational sleeve towards but spaced from a lower end of the rotational sleeve, with the rotational sleeve further including a second compartment extending from the lower end of the rotational sleeve but spaced from the first compartment along the longitudinal axis, with the umbrella further comprising:

a first bearing mounted in the first compartment and coupled to the axle of the coupling member; and a second bearing mounted in the second compartment and coupled to the axle of the coupling member, with the first and second bearings supporting rotational movement of the rotational sleeve.

6. The umbrella as claimed in claim 1, with the driving jacket further including a lip on a lower end thereof, with the umbrella further comprising:

a housing fixed around the fixing tube, with the housing including a space defined therein and an opening in communication with the space, with the housing further including an inner wall located in the space and spaced from the opening along the longitudinal axis, and with the lower end of the driving jacket slideably received in the space of the housing along the longitudinal axis, wherein with the driving jacket in the engagement position, the lip of the driving jacket abuts an upper end of the housing, and wherein with the driving jacket in the disengagement position, the lip of the driving jacket is spaced from the upper end of the housing along the longitudinal axis.

7. The umbrella as claimed in claim 1, with the coupling member further including a passage extending from an end face of a top end of the axle through a bottom face of the coupling portion, with the umbrella further comprising:

a guiding sleeve mounted around the axle of the coupling member, with the guiding sleeve including a conical hole intercommunicated with the passage of the coupling member, and with the guiding sleeve further including an outer periphery abutting the inner periphery of the movable tube;

a cable winding device mounted to the fixing tube and including a handle rotatably mounted outside of the fixing tube and a shaft jointly rotatable with the handle; and a cable including a winding end fixed to the shaft and a pull end fixed to the runner, with a portion of the cable received in the conical hole of the guiding sleeve and the passage of the coupling member, wherein with the runner in the lower position, rotation of the handle in a first direction causes the cable to be wound around the shaft, and the pull end of the cable pulls the runner to move from the lower position to the upper position, and wherein with the runner in the upper position, rotation of the handle in a second direction opposite to the first direction causes the cable to be released from the shaft, and the runner moves from the upper position to the lower position by gravity.

* * * * *